United States Patent [19]

Kretchman et al.

[11] 4,262,870

[45] Apr. 21, 1981

[54] RETRACTABLE SELF-LEVELING SUPPORT ASSEMBLY FOR AUTOMATIC WASHER

[75] Inventors: Gerald L. Kretchman; Russell J. Morrison, both of St. Joseph, Mich.

[73] Assignee: Whirlpool Corporation, Benton Harbor, Mich.

[21] Appl. No.: 56,683

[22] Filed: Jul. 11, 1979

[51] Int. Cl.[3] ..... F16M 11/20

[52] U.S. Cl. ..... 248/188.3; 248/649

[58] Field of Search ..... 248/188.3, 188.2, 446, 248/649, 650; 312/249, 253

[56] References Cited

U.S. PATENT DOCUMENTS

| | | | |
|---|---|---|---|
| 2,695,147 | 11/1954 | Castricone | 248/188.3 X |
| 3,186,670 | 6/1965 | Perl | 248/188.2 |
| 3,190,709 | 6/1965 | Dutcher et al. | 312/253 X |
| 3,222,021 | 12/1965 | Sisler | 248/188.3 |
| 3,304,032 | 2/1967 | Yates | 248/188.3 X |
| 3,448,950 | 6/1969 | Kluge | 248/649 |
| 3,954,241 | 5/1976 | Carlson | 248/188.3 |
| 3,991,962 | 11/1976 | Kovats | 248/188.3 X |
| 4,068,815 | 1/1978 | Losert | 248/188.2 |
| 4,124,187 | 11/1978 | Webb | 248/188.3 |

*Primary Examiner*—J. Franklin Foss

*Attorney, Agent, or Firm*—Hill, Van Santen, Steadman, Chiara & Simpson

[57] ABSTRACT

A retractable self-leveling assembly for supporting a laundry appliance such as an automatic washer is connected at a rear base portion of the appliance. The assembly has two spaced apart upwardly and outwardly angled slots therein for slidably receiving pins which connect supporting feet to opposite ends of an adjustable tension bar generally at right angles thereto. In a deployed position, the feet extend below the laundry appliance and the weight of the appliance on the feet and tension bar combination causes the pins to slide in the slots to automatically position the feet to compensate for any unevenness in the surface on which the appliance rests. The tension bar may be manually extended to retract the feet into the appliance cabinet during storage or transport of the appliance.

12 Claims, 10 Drawing Figures

FIG. 1
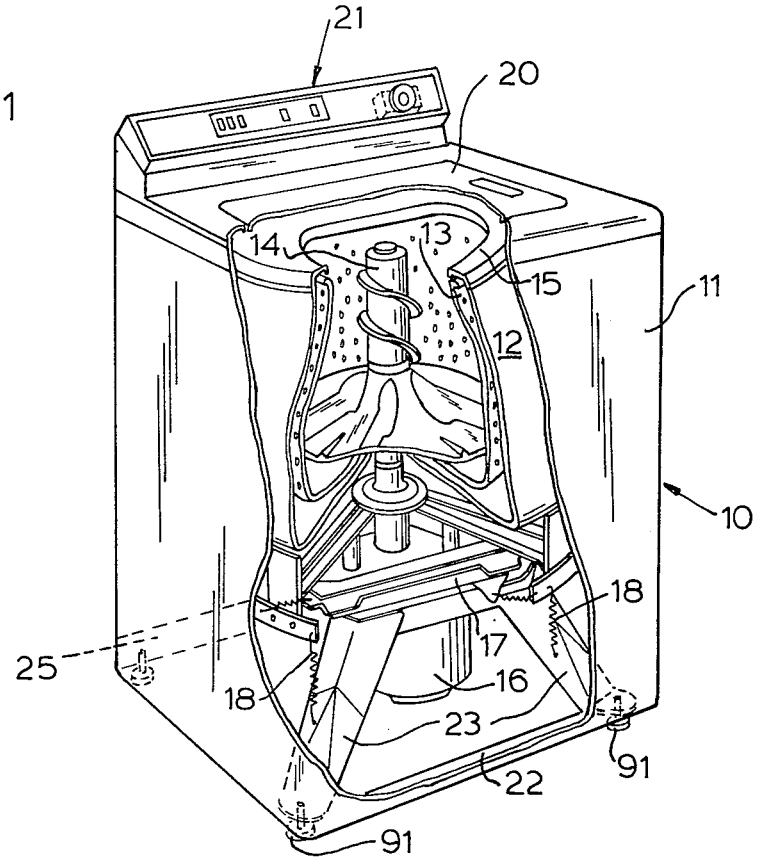
FIG. 2
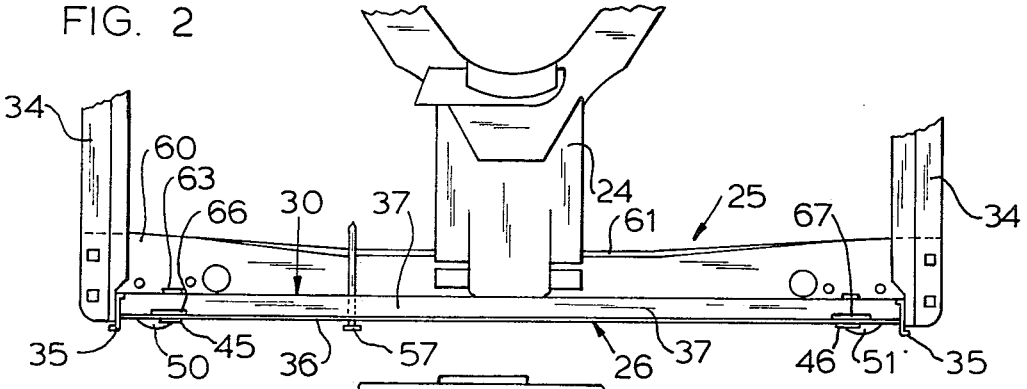
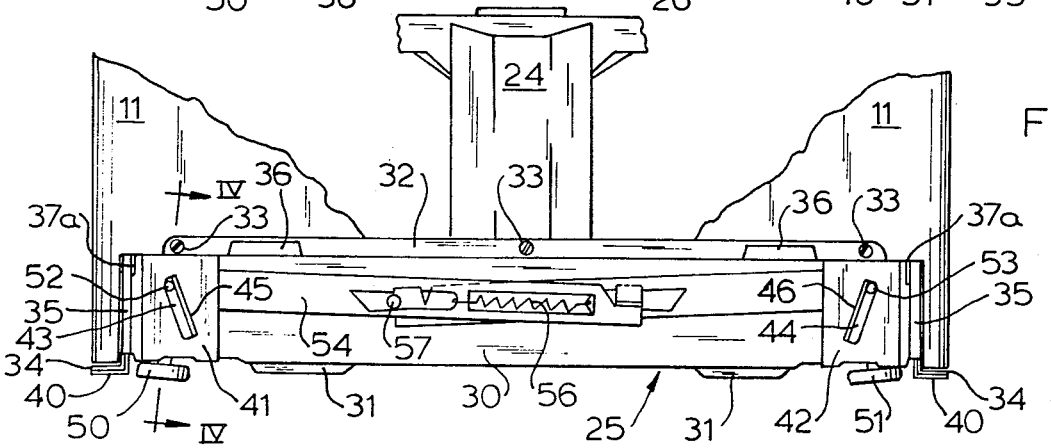
FIG. 3

RETRACTABLE SELF-LEVELING SUPPORT ASSEMBLY FOR AUTOMATIC WASHER

BACKGROUND OF THE INVENTION

1. Field of the Invention

The present invention relates to self-leveling support assemblies for heavy machinery, and in particular to such assemblies used in automatic laundry appliances.

2. Description of the Prior Art

Self-leveling support assemblies for use in redistributing uneven weight loading caused by setting an appliance on an uneven floor, or by vibrations produced in the operation of the appliance, are known in the art. Such assemblies utilize non-expandable tying means to connect two feet which are movable in a general vertical direction.

The assemblies known in the art have the disadvantage of having the feet deployed at all times, thus requiring special packing of the appliance in order to ensure stability of the appliance during shipping. Further, construction of the assemblies known in the art is such that damage to the assembly is likely should the appliance be moved an appreciable distance without such special packing.

SUMMARY OF THE INVENTION

The present invention is an improved self-leveling support assembly having a storage position and a deployed position. The assembly has a rigid horizontal frame member having upwardly diverging slots disposed at opposite ends thereof, covered by brackets having corresponding slots therein. A pin is slidably engaged in each of the pairs of slots, the pin connecting vertically movable feet to respective ends of an adjustable horizontal tension bar.

The adjustable tension bar is comprised of two slidably interlocking portions held together by a spring, each portion having a relieved section therein to receive a flanged end of the other portion, each relieved section having a notched surface arranged to engage the flange received in the relieved section and oppose horizontal movement of the portions with respect to each other. In the deployed position, the feet connected to the tension bar may rest on an uneven surface, and the pins connected to the tension bar will be free to slide in the upwardly diverging slots so as to allow leveling of the appliance and redistribution of the weight thereof.

The assembly is also movable to a retracted or storage position wherein the tension bar is manually extended to a greatest allowable length and pegged in that position by a pin inserted through the tension bar and received in the horizontal frame member. When the bar is in this position, the pins in the diverging slots are forced to the uppermost ends thereof, fully retracting the feet attached thereto, but maintaining the feet in a rigid, vertically disposed position to facilitate easy packing and movement without damage to the assembly, and still providing stability for the appliance.

BRIEF DESCRIPTION OF THE DRAWINGS

FIG. 1 is a perspective view, partly broken away, of a laundry appliance embodying a self-leveling support assembly constructed in accordance with the principles of the present invention.

FIG. 2 is a plan view of a self-leveling support assembly constructed in accordance with the principles of the present invention.

FIG. 3 is a front elevational view of the assembly of FIG. 2.

DESCRIPTION OF THE PREFERRED EMBODIMENTS

Figure 4:
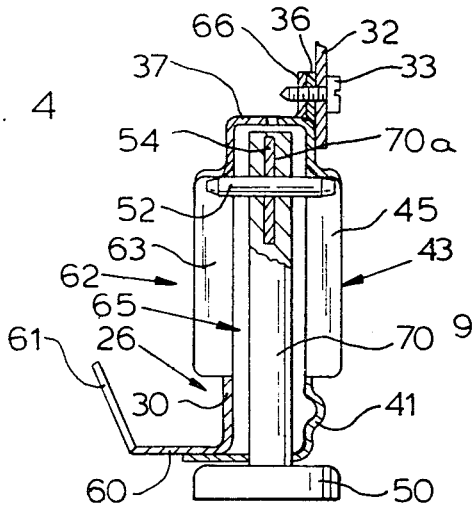
FIG. 4 is a sectional view taken along line IV—IV of FIG. 3.

Domestic appliances such as automatic laundry machines are frequently required to stand on uneven supporting surfaces, such as basement floors or the like. Proper functioning of such machines, in particular vertical axis washing machines having a high speed spin or centrifugal extraction cycle, requires that the machine be level. If the machine is not level the forces generated by the rotating basket and clothes load cause the machine to experience vibrations which are not only noisy, but may also result in structural damage to the machine. In some cases, the vibrations may be sufficient to cause the machine to "walk" over the surface on which it rests.

It is desirable that assemblies constructed to remedy this problem by leveling the appliance be self-leveling so that re-positioning of the appliance by the user will not require readjustment of the leveling assembly by the user. Additionally, storage and packing of the appliance without loss of stability can be achieved if the assembly is retractable to a storage position while still providing support for the appliance.

A laundry appliance of the vertical axis type embodying the principles of the present invention is shown generally at 10 in FIG. 1. The appliance 10 has an outer cabinet 11 which houses a stationary tub 12 therein, containing a perforate spin basket 13. An agitator 14 is vertically disposed inside the spin basket 13, and a generally circular opening 15 in the top of the tub 12 for entry and removal of laundry is covered by a hinged lid 20.

The appliance 10 is driven by a motor and drive means 16 which is supported on an interior frame 17. The frame 17 is supported in tripod fashion by two struts 23 connected at a front of the cabinet 11 to a cabinet base 22. A suspension mechanism 18 minimizes transfer of vibrations from the moving interior parts to the cabinet 11.

Figure 9:
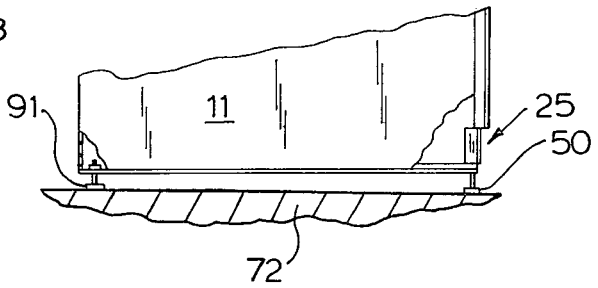
FIG. 9 is a side elevational view of the appliance of FIG. 1 showing the assembly of FIG. 2 in a deployed position.

As shown in FIG. 9, the front of the cabinet 11 is conventionally supported by threaded screw-adjustable feet 71, for limited selected manual adjustment of the height of the cabinet 11 above a supporting surface 72.

As shown in FIG. 2, a third strut 24 of the tripod supporting the frame 17 is connected to a self-levelling support assembly shown generally at 25. As best seen in FIGS. 2, 3 and 4, the assembly 25 consists of a horizontal frame member 26 made from sheet steel bent to form a vertical flat wall 30 and a horizontal flat wall 60 at a right angle thereto. A stiffening portion 61 of the horizontal wall 60 is bent partially upwardly to add strength to the mid point of the horizontal wall 60. The top of the vertical wall 30 is bent into an L-shaped configuration having a horizontal portion 37 and a vertical portion 36. As shown in FIG. 4, the vertical portion 36 engages a portion 32 of the cabinet 11 and is held in place by three machine screws 33. Outwardly extending ends 37*a* of the top horizontal portion 37 are bent downwardly to abut end brackets 35, and are attached thereto by any suitable means, such as by spot welding. Supporting brackets 40 are attached to the end brackets 35 such as by spot welding, and are connected to a cabinet frame 34.

Figure 10:
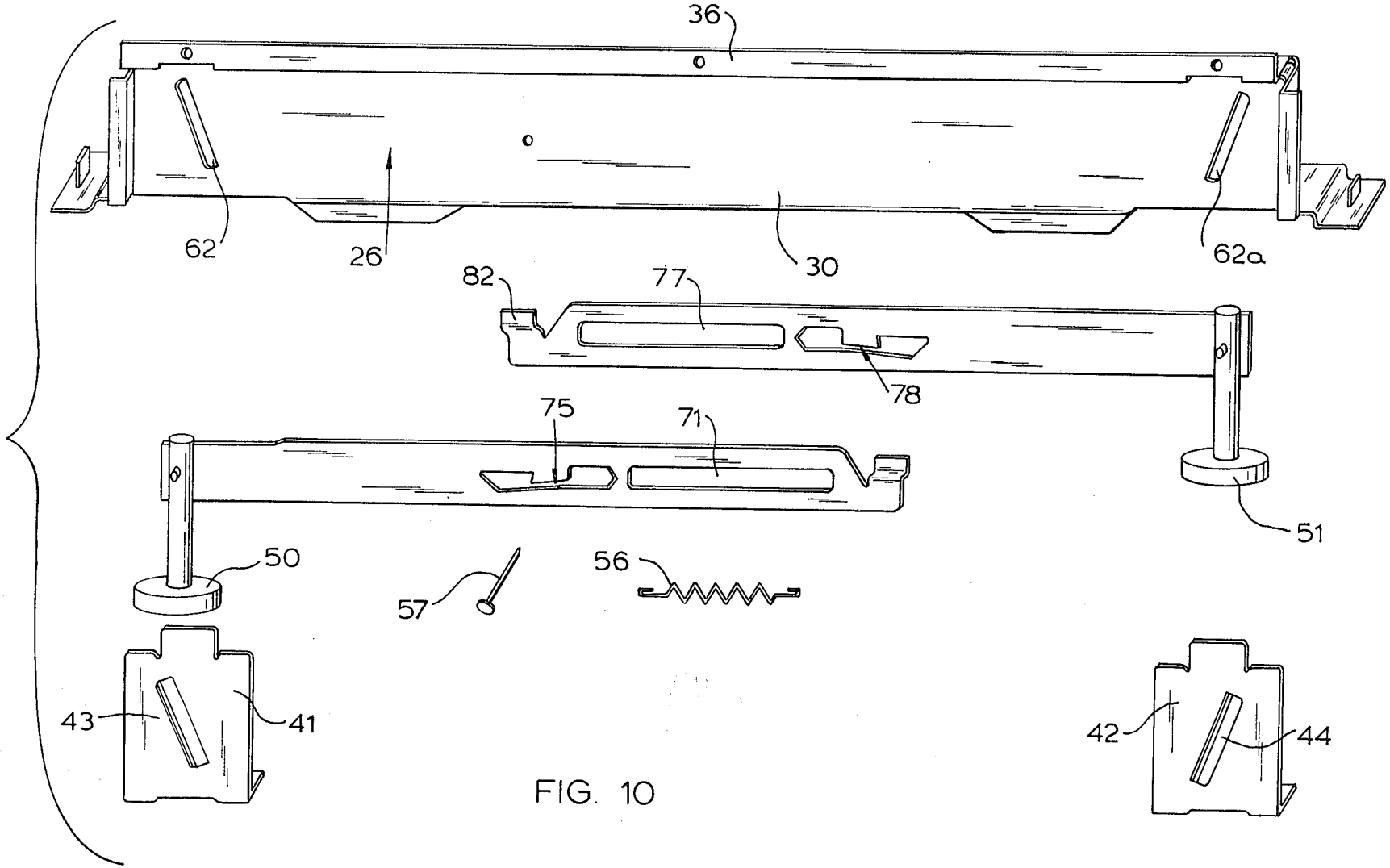
FIG. 10 is an exploded view of the self-leveling support assembly.

As shown in FIGS. 3, 4 and 10, a bracket 41 and a bracket 42 are connected respectively at the left and right ends of the assembly 25. The brackets are attached to the horizontal portion 60 of the frame member by any suitable means, such as by spot welding, and are held in place by an upwardly extending tab 66 which extends through slots in the top horizontal portion 37 of the frame and are held in place by respective ones of screws 33. The top horizontal portion 37 thus interconnected with bracket 41 forms a hollow chamber 65.

Upwardly and outwardly slanting slots 62 and 62*a* are formed in the frame as shown in FIG. 10. As shown in FIG. 4, this is accomplished by bending a severed portion 63 of the vertical wall 30 outwardly of chamber 65. A corresponding slot 43 is formed by bending a portion 45 of the bracket 41.

As best shown in FIGS. 2 and 3, the other bracket 42 has a slot 44 formed therein by bending a portion 46 of the bracket outwardly, the slot 44 slanting outwardly in a direction opposite to that of the slots 43 and 62 so as to register with slot 62*a*.

Figure 5:
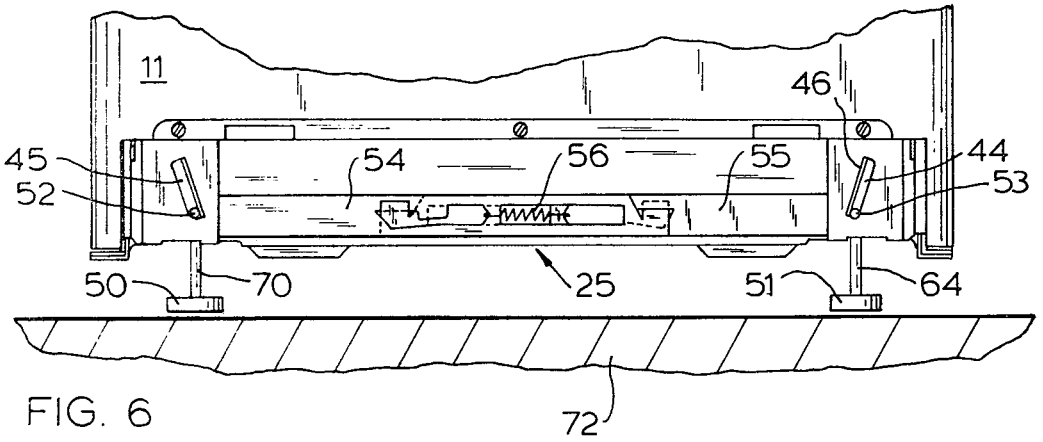
FIG. 5 is an elevational view of the assembly of FIG. 2 in a fully-extended deployed position immediately prior to the contact with a supporting surface.

Referring to FIGS. 3, 4 and 5, a pair of feet 50 and 51, having respective vertical legs 70 and 64 attached thereto, extend into the chambers 65 formed between the frame 26 and the brackets 41 and 42. A horizontal arm 54 extends into the area between the left bracket 41 and the frame 26, and is engaged in a slot 70*a* in the upper portion of the leg 70. The arm 54 is held therein by a horizontal pin 52 passing through the leg 70 and a corresponding hole in the arm 54. An identical assembly holds a second horizontal arm 55 in engagement with the leg 64, and the two are held together behind the right bracket 42 by a pin 53.

As assembled, each of the pins 52 and 53 are free to slide within the confines of the respective slots 43 and 44. The outwardly extending portions 45, 63 and 46 and the other outwardly extending wall not shown on the frame member 26 behind the bracket 42, provide bearing surfaces against which the pins 52 and 53 can move.

Figure 8:
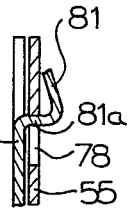
FIG. 8 is a sectional view taken along line VIII—VIII of FIG. 7.
Figure 7:
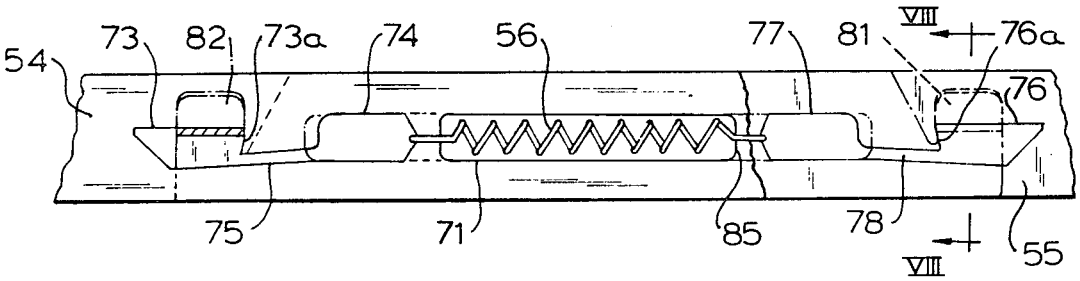
FIG. 7 is a partly cut away detailed view of the expandable tension arm of the assembly of FIG. 2.

As shown in detail in FIGS. 7, 8 and 10, the arm 54 has a flanged end 81 which is received in an aperture 76 in the other arm 55. The arm 55 has a similar flange 82 which is received in a similar aperture 73 in the arm 54. Extension of the assembled arm combination is opposed by a biasing spring 56 connected at its ends to each of the arms 54 and 55, and disposed in overlapping rectangular apertures 71 and 85 in the respective arms 54 and 55.

Each of the arms 54 and 55 has a respective second aperture 74 and 77 therein, connected by respective channels 75 and 78 to the apertures 73 and 76. A generally vertical portion 73*a* of the aperture 73 is disposed at one end of the channel 75, and a generally vertical portion 76*a* of the aperture 76 is disposed at an end of the channel 78.

As shown in FIG. 3, the assembly 25 may be placed in a retracted position by applying a downward force to move the arms 54 and 55 out of horizontal alignment, and by applying opposed outwardly directed forces to each of the arms 54 and 55 to extend the combination to a greatest length. This allows the flanges 81 and 82 to respectively move into the channels 78 and 75. When this occurs, the pins 52 and 53 are moved a greatest distance apart to the tops of the respective slots 43 and 44, thereby pulling the feet 50 and 51 into the cabinet 11. Because the spring 56 is now extended, the assembly must be pegged in this position, which is accomplished by means of a pin 57 inserted through an aperture in the vertical wall 30.

When the feet 50 and 51 are in the position shown in FIG. 3, the assembly is suitable for packing and/or movement of the appliance 10 without damage to the retracted feet. The stability of the appliance 10 is not lost, however, because the feet 50 and 51 in addition to dimples 31 extending downwardly from the horizontal wall 60, provide a secure means for supporting the appliance 10, even in the retracted position.

Figure 6:
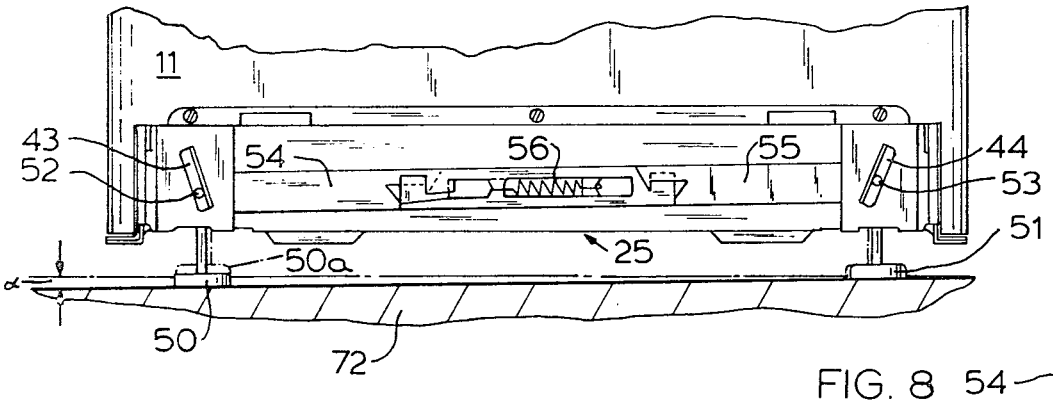
FIG. 6 is an elevational view of the assembly of FIG. 2 in a deployed position on a non-level supporting surface.

Prior to placing the assembly 25 in the deployed positions shown in FIGS. 5 and 6, the front adjustable feet 91 are adjusted to level the front of the appliance 10 on a supporting surface 72 as best as can be achieved. The rear portion of the appliance 10 is raised so that no weight is being supported by the assembly 25, the pin 57 is removed and the arms 54 and 55 are moved back into horizontal alignment. Referring to FIG. 5, the spring 56 will contract pulling the arms 54 and 55 together while the flange 82 slides through the channel 75 into aperture 73 and the flange 81 slides through the channel 78 into aperture 76. Flange 81 and 82 will continue to be moved by spring 56 in respective apertures 76 and 73 until contact is made with end walls opposite respective vertical portions 76*a* and 73*a*. The arm combination is thus now in a rigid, non-expandable form, and the feet 50 and 51 are fully extended with the pins 52 and 53 at the bottom of the respective slots 45 and 44. As weight is brought to bear on the rear of the appliance 10, as shown in FIG. 6, the feet 50 and 51 will engage the supporting surface 72 which may be slanted an angle from the horizontal. Extension of the arms 54 and 55 is now prevented because the flanges 81 and 82 abut a limiting means comprising vertical walls 76*a* and 73*a* respectively. Instead of assuming a position 50*a* level with the foot 51, the foot 50 will rest against the supporting surface 72, so that the pin 52 will not slide as far in the slot 43 as the pin 53 slides in the slot 44. The arm combination 54 and 55 will thus be slightly canted but the cabinet 11 and the appliance 10 will be level.

If the appliance 10 is subsequently moved by a user, the assembly 25 will automatically readjust to a changing angle to that the rear of the appliance 10 will automatically be self-leveled whenever moved.

Although changes and modifications may be suggested by those skilled in the art it is the intention of the inventors to embody within the patent warranted hereon all changes and modifications as reasonably and properly come within the scope of their contribution to the art.

The embodiments of the invention in which an exclusive property or privilege is claimed are defined as follows:

1. In a self-leveling weight support assembly having a horizontal frame with upwardly diverging slots at opposite ends thereof, pins slidably engaged in said slots and connecting downwardly extending feet to opposite ends of a horizontal connecting member, the improvement comprising:

said connecting member including:

two slidably engaged partially overlapping arms, biasing means connected to each of said arms opposing horizontal expansion thereof, limiting means integrally formed on each arm to limit expansion of said connecting member, and retaining means removably receivable in said connecting member and said frame to retain said connecting member in an expanded position, whereby said feet are maintained adjacent said frame when said connecting member is expanded and said retaining means is received, and said feed are each extended from said frame a distance to compensate for an uneven supporting surface engaging said feet when said retaining means is removed.

2. The improvement of claim 1 wherein said limiting means is comprised of a tab formed on opposed ends of each said arm, means forming an opening in each said arm comprised of a first portion closest to a respective end of said connecting member, said first portion receiving said tab of the other arm when said connecting member is in a contracted position, a second portion nearest a center of said connecting member for receiving the tap of the other arm when said connecting member is in an expanded position, a slot connecting respective first and second portions allowing movement of each tab between said portions, and a vertical wall comprising a part of a perimeter nearest a center of said connecting member of each said first portion selectively engageable with each of said tabs to limit expansion of said connecting member.

3. A self-leveling support system for a domestic appliance having a base, a cabinet extending upwardly from said base and attached thereto, and operating components disposed within said cabinet, said self-leveling support system comprising:

two threaded screw-adjustable feet received in a front of said base for partial manual leveling thereof;

a self-leveling support assembly connected to a rear of said appliance acting in combination with said manually adjustable feet to automatically complete leveling of said appliance, said self-leveling weight support assembly comprising:

a frame connected to a rear of said base;

a leg assembly including downwardly extending feet slidably connected to said frame for general vertical movement with respect thereto;

said leg assembly being slidably movable to a storage position with said feet connected thereto retracted to a position adjacent said frame;

said leg assembly also being slidably movable to a deployed position wherein said leg assembly automatically moves to an optimal position for leveling said rear of said appliance in response to uneven displacement of said feet connected thereto;

a biasing means to automatically move said leg assembly from said storage position to said deployed position; and a removable retaining means insertable in said frame and said leg assembly to retain said leg assembly in said storage position.

4. A self-leveling weight support assembly comprising:

a frame having chambers at opposite ends thereof;

an expandable tension bar having ends generally contained in respective ones of said chambers, said tension bar having a contracting spring bias;

releasable means carried on said tension bar to limit expansion thereof, said releasable means releasable to allow said tension bar to expand;

two weight supporting feet each having leg portions attached thereto generally vertically contained in respective ones of said chambers;

connecting means for connecting a respective leg portion and tension bar end contained in each chamber;

guide means contained in each chamber for receiving said connecting means to limit movement thereof and to guide said connecting means to move said tension bar and lift said feet as weight is placed on said feet;

each said connecting means moving in said guide means to provide movement of said feet sufficient to allow said feet to adjust to an uneven support surface;

said guide means allowing said shafts to be completely retracted into said chambers when said releasable means is released; and removal retaining means for opposing said spring-bias to maintain said tension bar in an expanded condition.

5. The self-leveling weight support assembly of claim 4 wherein said tension bar is comprised of two slidably engaged partially overlapping arms having overlapping ends each connected to a spring to oppose expansion of said tension bar.

6. The self-leveling weight support assembly of claim 5 wherein said release means is comprised of tabs respectively disposed at opposed ends of each arm not connected to said spring, and respective wall means forming openings in each arm comprising a first portion disposed closest to the ends of said tension bar for receiving a tab of the other arm when said tension bar is in a contracted position, a second portion in each arm disposed nearest a center of said tension bar for receiving a tab of the other arm when said tension bar is in an expanded position, and a slot connecting respective first and second portions of each opening to allow movement of the tab between said first and second portions, and a vertical wall portion forming a part of a perimeter nearest the center of said tension bar of each said first portion for selective engagement with a respective tab to limit expansion of said tension bar.

7. The self-leveling weight support assembly of claim 5 wherein said retaining means consists of a pin insertable in a receptacle aligned with one of the ends of said arms having a tab thereon when said tension bar is in said expanded position.

8. The self-leveling weight support assembly of claim 4 wherein said chambers are comprised of two parallel vertical walls a first of which is a portion of said frame and a second of which is a vertical portion of a bracket fitted over each end of said frame and attached thereto.

9. The self-leveling weight support assembly of claim 8 wherein said guide means are pairs of aligned upwardly diverging slots in said frame and brackets, and said connecting means are dowels passing through aligned apertures in each shaft and a respective end of said tension bar and extending through a respective pair of aligned slots.

10. The self-leveling weight support assembly of claim 9 wherein said slots are formed by outwardly bending portions of said frame and said brackets which are partially severed therefrom to form support surfaces against which said dowels slide.

11. A self leveling support assembly for a laundry appliance having a storage position and a deployed position comprising:

a rigid horizontal frame member having upwardly diverging slots disposed at opposite ends thereof;

bracket means having corresponding slots in register with said upwardly diverging slots for forming a pair of guides;

a pin slidably engaged in each of the guides;

vertically movable feet connected to opposite ends of an adjustable tension bar;

said tension bar comprising two slidably interlocking portions biased together with a spring;

each portion having a slot therein to receive a flanged end to the other of said two portions, whereby said feet on said tension bar may rest on an uneven surface and the tension bar will be free to slide in the slots so as to allow leveling of the appliance.

12. The self-leveling support assembly of claim 11 wherein said assembly is movable to a retracted storage position wherein the tension bar is manually extended to a greatest allowable length.

* * * * *